US010883356B2

(12) United States Patent
Jeffryes et al.

(10) Patent No.: US 10,883,356 B2
(45) Date of Patent: Jan. 5, 2021

(54) AUTOMATED SLIDING DRILLING

(71) Applicant: SCHLUMBERGER TECHNOLOGY CORPORATION, Houston, TX (US)

(72) Inventors: Benjamin P. Jeffryes, Cambridge (GB); Rustam Isangulov, Katy, TX (US); Ginger Hildebrand, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/304,772

(22) PCT Filed: Apr. 17, 2015

(86) PCT No.: PCT/US2015/026390
§ 371 (c)(1),
(2) Date: Oct. 17, 2016

(87) PCT Pub. No.: WO2015/161209
PCT Pub. Date: Oct. 22, 2015

(65) Prior Publication Data

US 2017/0037722 A1 Feb. 9, 2017

Related U.S. Application Data

(60) Provisional application No. 61/981,031, filed on Apr. 17, 2014.

(51) Int. Cl.
*E21B 44/02* (2006.01)
*E21B 7/06* (2006.01)
(Continued)

(52) U.S. Cl.
CPC ..... *E21B 44/02* (2013.01); *E21B 4/02* (2013.01); *E21B 7/067* (2013.01); *E21B 44/00* (2013.01);
(Continued)

(58) Field of Classification Search
CPC . E21B 4/02; E21B 44/00; E21B 44/02; E21B 44/04; E21B 47/024; E21B 47/12; E21B 7/067
See application file for complete search history.

(56) References Cited

U.S. PATENT DOCUMENTS 5,517,464 A 5/1996 Lerner et al.
6,050,348 A 4/2000 Richarson et al.
(Continued)

OTHER PUBLICATIONS

International Search Report and Written Opinion for corresponding PCT Application Serial No. PCT/US2015/026390, dated Jul. 15, 2015, 14 pages.

*Primary Examiner* — David J Bagnell
*Assistant Examiner* — Dany E Akakpo
(74) *Attorney, Agent, or Firm* — Rachel E. Greene

(57) ABSTRACT

Automated control of a drillstring in a borehole, which is not in continuous rotation, the drillstring comprising an angled component (a bent sub or the like) and a downhole means of rotating the bit, such as a motor or turbine, which rotates the bit independently of drillstring rotation. Near the distal end of the drillstring are measurement devices, at least one and in some aspects two or more, which are used to measure the orientation of the drillstring/bent sub/bottomhole assembly/drill bit with respect to a geophysical field of the earth, such as magnetism (magnetic toolface) or gravity (gravitational toolface). These measurement devices may be connected to a communications module which transmits the downhole toolface information to the surface. The drillstring is controlled to provide that based upon the downhole measurements the drilling system drills the borehole in a desired trajectory.

17 Claims, 4 Drawing Sheets

(51) Int. Cl.

| | |
|---|---|
| ***E21B 44/00*** | (2006.01) |
| ***E21B 4/02*** | (2006.01) |
| ***E21B 44/04*** | (2006.01) |
| ***E21B 47/024*** | (2006.01) |
| ***E21B 47/12*** | (2012.01) |

(52) U.S. Cl.
CPC ..... *E21B 44/04* (2013.01); *E21B 47/024* (2013.01); *E21B 47/12* (2013.01)

(56) References Cited

U.S. PATENT DOCUMENTS

| | | | |
|---|---|---|---|
| 6,338,390 | B1 | 1/2002 | Tibbitts |
| 6,641,434 | B2 | 11/2003 | Boyle et al. |
| 6,802,378 | B2 | 10/2004 | Haci et al. |
| 6,866,306 | B2 | 3/2005 | Boyle et al. |
| 6,918,453 | B2 | 7/2005 | Haci et al. |
| 7,096,979 | B2 | 8/2006 | Haci et al. |
| 7,152,696 | B2 | 12/2006 | Jones |
| 7,404,454 | B2 | 7/2008 | Hulick |
| 7,413,021 | B2 | 8/2008 | Madhavan et al. |
| 7,461,705 | B2 | 12/2008 | Hulick et al. |
| 7,588,100 | B2 | 9/2009 | Hamilton |
| 7,802,634 | B2 | 9/2010 | Boone |
| 7,810,584 | B2 | 10/2010 | Haci et al. |
| 7,823,655 | B2 † | 11/2010 | Boone |
| 8,360,171 | B2 | 1/2013 | Boone et al. |
| 8,387,720 | B1 | 3/2013 | Keast et al. |
| 8,528,663 | B2 | 9/2013 | Boone |
| 8,602,126 | B2 | 12/2013 | Boone et al. |
| 8,672,055 | B2 | 3/2014 | Boone et al. |
| RE44,956 | E | 6/2014 | Richardson et al. |
| RE44,973 | E | 7/2014 | Richardson et al. |
| 8,939,233 | B2 | 1/2015 | Edbury et al. |
| 8,939,234 | B2 | 1/2015 | Mebane, III et al. |
| 9,145,768 | B2 | 9/2015 | Normore et al. |
| 9,249,655 | B1 | 2/2016 | Keast et al. |
| 9,290,995 | B2 | 3/2016 | Boone et al. |
| 9,359,881 | B2 | 6/2016 | DiSantis |
| 9,404,307 | B2 | 8/2016 | Maidla |
| 9,506,336 | B2 | 11/2016 | Orbell |
| 9,593,567 | B2 | 3/2017 | Pink et al. |
| 9,609,760 | B2 | 3/2017 | Saeki et al. |
| 9,650,880 | B2 | 5/2017 | Bowley et al. |
| 9,689,250 | B2 | 6/2017 | Badkoubeh et al. |
| 9,784,035 | B2 | 10/2017 | Boone et al. |
| 10,036,678 | B2 | 7/2018 | Fisher, Jr. et al. |
| 10,125,598 | B2 | 11/2018 | Dykstra et al. |
| 10,208,580 | B2 | 2/2019 | Benson et al. |
| 10,301,877 | B2 | 5/2019 | Schaaf et al. |
| 10,487,642 | B2 | 11/2019 | Haci et al. |
| 2004/0222023 | A1 * | 11/2004 | Haci ..... E21B 7/068 175/61 |
| 2004/0238222 | A1 | 12/2004 | Harrison |
| 2006/0081399 | A1 | 4/2006 | Jones |
| 2009/0078462 | A1 | 3/2009 | Boone et al. |
| 2009/0166087 | A1 | 7/2009 | Braden et al. |
| 2012/0024606 | A1 | 2/2012 | Pirovolou et al. |
| 2013/0032407 | A1 | 2/2013 | Edbury et al. |
| 2016/0047219 | A1 | 2/2016 | Jeffryes |
| 2016/0186551 | A1 * | 6/2016 | Dykstra ..... E21B 47/02 175/24 |
| 2016/0265334 | A1 * | 9/2016 | Dykstra ..... E21B 44/02 |

* cited by examiner
† cited by third party

AUTOMATED SLIDING DRILLING

CROSS-REFERENCE TO RELATED APPLICATION

This application claims benefit of U.S. Provisional Patent App. Ser. No. 61/981,031 filed Apr. 17, 2014, which is herein incorporated by reference in its entirety.

BACKGROUND

Large numbers of boreholes are drilled worldwide on an annual basis to provide for the production of hydrocarbon from subterranean reservoirs. Typically, rotary drilling techniques are used to form the boreholes, a technique in which a top-drive or rotary table rotates a drillstring in the borehole. A drill bit at the end of the drillstring is rotated at the bottom of the borehole to gouge the borehole through an earth formation. In general, rotary drilling may be used when straight-hole direction is needed, although rotary steering systems may also be used to provide for directional drilling when equipped with a rotary steering system.

Slide drilling/sliding/sliding drilling refers to drilling procedures where a downhole motor, such as a mud motor or turbine, is used to rotate the drill bit downhole, without rotating the drillstring from the surface. In such scenarios, the bottomhole assembly (BHA), which is the assembly that includes the drill bit, may be fitted with a bent sub or a bent housing mud motor or the like, to provide for directional drilling. In a mud motor, drilling fluid is forced through the drillstring and rotates the motor and, in turn, the drill bit.

Directional drilling using a downhole motor (sliding drilling) is conceptually very simple: point the bent sub and the drill bit in the desired direction and rotate the drill bit against the formation without rotating the drillstring. In this way, the drill bit drills in the direction it is pointing. When a desired wellbore direction is attained by the sliding drilling, rotary drilling from the surface may be resumed to provide that the drilling system continues drilling in a straight line in the direction it is pointing. By controlling the amount of hole drilled in the sliding versus the rotating mode, the wellbore trajectory can be controlled. In the drilling procedures, friction between the drillstring and the borehole may increases as a function of the horizontal component of the borehole being drilled, and may slow drilling by reducing the force that pushes the bit into new formations. Thus, while directional drilling concepts may be fairly simple, the actual dynamics of the drillstring and, as a result, the direction of drilling, are complex.

Directional drilling in a sliding drilling procedure requires accurate orientation of the bent sub and/or the bent segment of the downhole motor that directs the drill bit in the borehole. Rotating the drillstring changes the orientation of the bent segment and the toolface. To effectively steer the assembly, the driller, which may be a person or an automated system, must determine a toolface orientation. This may be done using measurement-while-drilling (MWD) systems that measure drilling parameters and the like during drilling operations. To direct the sliding drilling, the driller may rotate the drillstring to change the toolface orientation.

SUMMARY

In some embodiments of the present disclosure, sensors/measurement devices are disposed near the distal end of the drillstring to measure the orientation of the drillstring with respect to at least one of a geophysical field of the earth, such as magnetism (magnetic toolface) or gravity (gravitational toolface).

In some embodiments, the downhole orientation of the drillstring (or a bent sub or the like disposed thereon), is controlled through rotation of the drillstring at surface, from one fixed position to another, based solely on downhole measurements.

In some embodiments of the present disclosure, rotation of the drillstring at the surface comprises applying impulses to the drillstring until the surface drillstring orientation is within a range of angles which it has been determined are likely to result in a downhole toolface within an acceptable range to produce a desired drilling trajectory, thus one or more impulses are initially applied until the surface orientation is within the correct range.

In some embodiments of the present disclosure, torque may be applied to the drillstring so that it oscillates between maximum torque value and a minimum torque value in a rocking motion, with a zero sum of the maximum and minimum torque applied. The downhole toolface is transmitted to surface, and if it is determined that the well trajectory is too far from a planned trajectory, then the maximum and minimum values of the applied torque are changed, with the sum of the maximum and minimum no longer being close to zero.

In some embodiments of the present disclosure, after the surface torque variation has returned to zero-sum values, the determination is made as to whether the surface orientation is, when averaged over one or more torque variation cycles, within the acceptable range, and based on this a decision is made as to whether to apply another non zero-sum set of torque values for a time. Again, if based on downhole measurements, the surface ranges are found not to be correct, they are updated and a further non-zero sum set of cycles applied.

BRIEF DESCRIPTION OF THE DRAWINGS

The present disclosure is described in conjunction with the appended figures. It is emphasized that, in accordance with the standard practice in the industry, various features are not drawn to scale. In fact, the dimensions of the various features may be arbitrarily increased or reduced for clarity of discussion.

Figure 1A:
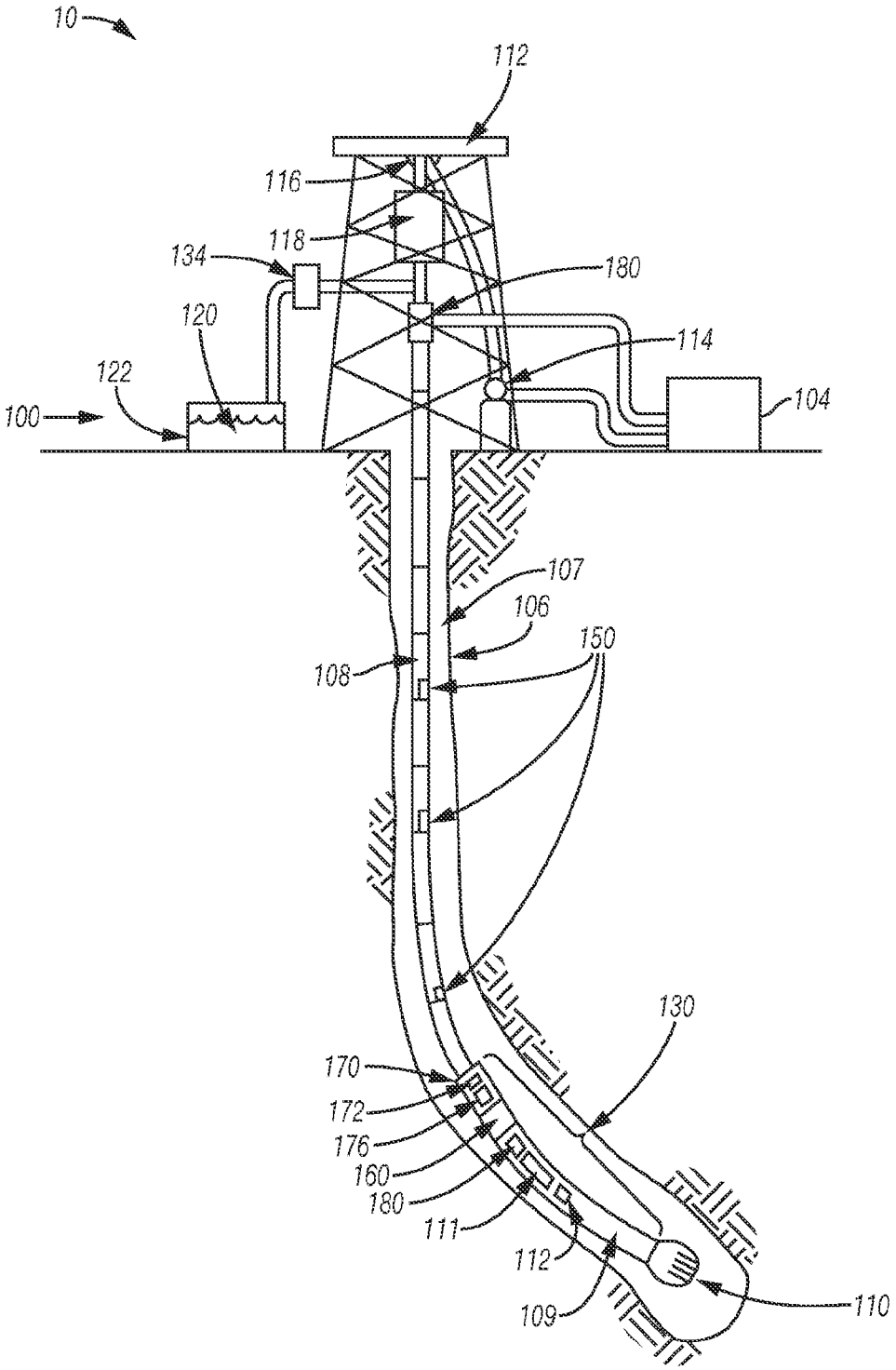
FIG. 1A illustrates a drilling system for operation at a wellsite to drill a borehole through an earth formation.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DESCRIPTION

Embodiments of the present invention relates to controlling/driving a directional drilling system—comprising a top drive, a drillstring, a drill bit and a directional device, such as a bent sub or the like—to drill a borehole through an earth formation in accordance with a desired trajectory. Some embodiments of the present invention provide for monitoring a downhole orientation of the directional drilling system and adjusting a torque applied to the drillstring and/or a weight-on-bit to adjust the orientation. In some embodiments, displays are provided of the status of the directional drilling system to provide for a driller or a controller to control the drilling system to drill a borehole according to a desired trajectory.

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention.

Specific details are given in the following description to provide a thorough understanding of the embodiments. However, it will be understood by one of ordinary skill in the art that embodiments maybe practiced without these specific details. For example, well-known circuits, processes, algorithms, structures, and techniques may be shown without unnecessary detail in order to avoid obscuring the embodiments.

As disclosed herein, the term "computer readable medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1A illustrates a drilling system for operation at a wellsite to drill a borehole through an earth formation.

The drilling system 10 may comprise a terminal 104. The terminal 104 may be, for example, a desktop computer, a laptop computer, a mobile cellular telephone, a personal digital assistant ("FDA"), a 4G mobile device, a 3G mobile device, a 2.5G mobile device, a satellite radio receiver and/or the like. The terminal 104 preferably has a processor for processing data received by the terminal 104. The terminal 104 may be located at the surface and/or may be remote relative to a wellsite 100.

In some embodiments, the terminal 104 may be located in the wellbore 106. The present disclosure is not limited to a specific embodiment or a specific location of the terminal 104, and the terminal 104 may be any device that may be used in the system 10. Any number of terminals may be used to implement the system 10, and the present disclosure is not limited to a specific number of terminals.

The drilling system 10 comprises a drillstring 108 suspended within a wellbore 106, and a drill bit 110 may be located at the lower end of the drillstring 108. The drillstring 108 and the walls of the wellbore 106 may form an annulus 107.

The drilling system 10 may comprise a land-based platform and derrick assembly 112 positioned over the wellbore 106. The assembly 112 may comprise a hook 116, and/or a top drive 118, which may be suspended from the hook 116. The top drive 118 may have one or more motors (not shown) and/or may rotate the drill string 108.

The assembly 112 may have drawworks 114 to raise, suspend and/or lower the drill string 108. During drilling, the drawworks 114 may be operated to hold the drill string 108 and to control and/or maintain a selected axial force as weight-on-bit ("WOB") to the drill bit 110. More specifically, a portion of the weight of the drill string 108 is suspended by the drawworks 114, and an unsuspended portion of the weight of drill string 108 is transferred to the drill bit 110 as the WOB. The drawworks 114 may have an encoder (not shown in the drawings) which may be configured to determine the depths of points along the drill string 108. The terminal 104 may be communicatively connected to the encoder to generate a log of depth of the drill bit 110 as a function of time.

Drilling fluid 120 may be stored in a reservoir 122 formed at the wellsite 100. A pump 134 may deliver the drilling fluid 120 to the interior of the drill string 108 to induce the drilling fluid 120 to flow downward through the drill string 108. A mud motor 111 may use the flow of the drilling fluid 120 to generate electrical power. The drilling fluid 120 may exit the drill string 108 through ports or nozzles (not shown) in the drill bit 110 and then may circulate upward through the annulus 107. Thus, the drilling fluid 120 may lubricate the drill bit 110 and may carry formation cuttings up to the surface as the drilling fluid 120 returns to the reservoir 122 for recirculation.

Sensors 150 at various locations at the wellsite 100 may collect data, preferably in real-time, concerning the operation and the conditions of the wellsite 100. The sensors 150 may have image generation capabilities. For example, one or more of the sensors 150 may be sensors which may provide information about surface conditions, such as, for example, standpipe pressure, hookload, depth, surface torque, rotary rpm and/or the like. One or more of the sensors 150 may be downhole sensors and/or may be disposed within the wellbore 106 to provide information about downhole conditions, such as, for example, wellbore pressure, weight-on-bit, torque-on-bit, direction, inclination, collar rpm, tool temperature, annular temperature, toolface, along-string measurements and/or the like. The information obtained by the sensors 150 may be transmitted to various components of the system 10, such as, for example, the terminal 104.

The drillstring 108 may comprise a BHA 130 proximate to the drill bit 110. The drill bit 110 may be connected to a bent sub 109, which may be angled relative to the BHA 130. In some embodiments, the bent sub 109 may be angled approximately two degrees or less relative to the BHA 130.

In some embodiments, the mud motor 111 may be connected to the bent sub 109. The mud motor 111 may rotate the drill bit 110 without rotating the bent sub 109. In this way, the drill bit 110 may be rotated against an earth formation while being pointed in a direction by the bent sub 109. The bent sub 109 may be coupled with the drill string 108 and rotation of the drill string 108 may be used to change an orientation of the bent sub 110 in the borehole/wellbore.

The mud motor 111 and/or the bent sub 109 may be connected to a mechanical transmission 112. The mechanical transmission 112 may prevent rotation of the bent sub 109 relative to the remainder of the drill string 108 if the drill string 108 is rotating or may allow for rotation of the bent sub 109 with the drill string 108. Similarly, the mechanical transmission 112 may enable the mud motor 111 to rotate the bent sub 109 or to hold the bent sub 109 stationary while the mud motor 11 is rotating the drill bit 110, when the drill string 108 is sliding. Within the bent sub, may be a drive shaft attached to the mud motor 111 and the drill bit 110.

The BHA 130 may have one or more tools (not shown) for measuring, processing and/or storing information and/or communicating with the terminal 104. Additionally, the BHA 130 may have mud motors, rotary steerable assemblies and/or reamers which may divert a portion of the drilling fluid 120 to the annulus.

For example, the BHA 130 may have a logging-while-drilling (LWD) module 160. The LWD module 160 may be housed in a -drill collar of the BHA 130 and may have one or more known types of logging tools. The LWD module 160 may have capabilities for measuring and processing data acquired from and/or through the wellbore 106. In addition, the LWD module 160 may measure properties of the one or more subsurface formations adjacent to the wellbore 106.

The BHA 130 may have a measuring-while-drilling (MWD) module 170. The MWD module 170 may be housed in a drill collar located at the upper end of the BHA 130 and may have one or more devices for measuring characteristics of the drill string 108 and the drill bit 110. For example, the MWD module 170 may measure physical properties, such as, for example, pressure, temperature and/or wellbore trajectory. The MWD module 170 may have a D&I sensor 172 which may determine the inclination and the azimuth of the BHA 130. For example, the D&I sensor 172 may use an accelerometer and/or a magnetometer to determine the inclination and the azimuth of the BHA 130. The D&I sensor 172 may use any means for determining the inclination and the azimuth of the BHA 130 known to one having ordinary skill in the art.

The BHA 130 may have a toolface sensor 180 which determines the toolface orientation of the BHA 130. The toolface sensor 180 may use one or more magnetometers and/or one or more accelerometers to determine the azimuthal orientation of the BHA 130 relative to the earth's magnetic north and/or may use one or more gravitation sensors to determine the azimuthal orientation of the BHA 130 relative to the earth's gravity vector. The toolface sensor 180 may use any means for determining the toolface orientation of the BHA 130 known to one having ordinary skill in the art.

The MWD module 170 may have a mud flow telemetry device 176 which may selectively block passage of the drilling fluid 20 through the drill string 108. The mud flow telemetry device 176 may transmit data from the BHA 130 to the surface by modulation of the pressure in the drilling fluid 20. Modulated changes in pressure may be detected by a pressure sensor 180 communicatively connected to the terminal 104. The terminal 104 may interpret the modulated changes in pressure to reconstruct the data sent from the BHA 130. For example, the mud flow telemetry device 176 may transmit the inclination, the azimuth and the toolface orientation to the surface by modulation of the pressure in the drilling fluid 20, and the terminal 104 may interpret the modulated changes in pressure to obtain the inclination, the azimuth and the toolface orientation of the BHA 130. The mud pulse telemetry may be implemented using a system such as that described in U.S. Pat. No. 5,517,464 assigned to the assignee of the present disclosure. Alternatively, wired drill pipe, electromagnetic telemetry and/or acoustic telemetry may be used instead of or in addition to mud pulse telemetry. For example, mud pulse telemetry may be used in conjunction with or as backup for wired drill pipe as described hereafter.

Wired drill pipe may communicate signals along electrical conductors in the wired drill pipe. Wired drill pipe joints may be interconnected to form the drill string 108. The wired drill pipe may provide a signal communication conduit communicatively coupled at each end of each of the wired drill pipe joints. For example, the wired drill pipe preferably has an electrical and/or optical conductor extending at least partially within the drill pipe with inductive couplers positioned at the ends of each of the wired drill pipe joints. The wired drill pipe may enable communication of the data from the BHA 130 to the terminal 104. Examples of wired drill pipe that may be used in the present disclosure are described in detail in U.S. Pat. Nos. 6,641,434 and 6,866,306 to Boyle et al. and U.S. Pat. No. 7,413,021 to Madhavan et al. and U.S. Patent App. Pub. No. 2009/0166087 to Braden et al., assigned to the assignee of the present application. The present disclosure is not limited to a specific embodiment of the telemetry system. The telemetry system may be any system capable of transmitting the data from the BHA 130 to the terminal 104 as known to one having ordinary skill in the art.

The wellbore 106 may be drilled according to a well plan established prior to drilling. The well plan typically sets forth equipment, pressures, trajectories and/or other parameters that define the drilling process for the wellsite 100. The well plan may establish a target location, such as, for example, a location within or adjacent to a reservoir of hydrocarbons, and/or may establish a drilling path by which the drill bit 110 may travel to the target location. The drilling operation may be performed according to the well plan.

However, as the information is obtained, the drilling operation may need to deviate from the well plan. For example, as drilling or other operations are performed, the subsurface conditions may change, and the drilling operation may require adjustment. The drilling system described above may be used in a process called sliding drilling. In sliding drilling the drillstring comprises a bent/angled element/sub that points the drill bit in a direction. As such, the drilling system may be operated to drill a borehole according to a desired trajectory so that the borehole may be drilled so that is passes through areas of the subsurface, i.e., so as to miss certain types of formations and/or to pass through zones containing hydrocarbons. In sliding drilling a downhole motor, which may comprise a mud motor, a turbine and/or the like may be used to rotate the drill bit. Drilling fluid forced through the drillstring is used to power the downhole motor, turbine and/or the like and rotate the drill bit.

In sliding drilling, the drilling system may be steered in any direction, including the drilling of horizontal sections of the borehole. In practice, friction between the drillstring and an inner-wall of the borehole being drilled bore increases as a function of the horizontal component of the borehole. This friction and the angling of the drillstring when not drilling vertically serve to reduce the force acting on the drill bit.

To produce a desired drilling trajectory, an orientation of the bent sub, must be controlled. For example, the drillstring may be rotated at the surface to produce a change in the downhole orientation of the bent sub. While such rotation of the drillstring to produce a rotation of the bent sub is effective for a vertical drillstring system, as previously noted, frictional effects affect the drillstring when it is not vertical and, as such, a rotation of the drillstring at surface when the drillstring is not vertical may not produce a desired rotation of the bent sub downhole. Consequently, it may require several rotations of the drillstring at the surface to overcome the friction effects before the surface rotation is translated to rotation of the bent sub/drill bit.

In sliding drilling, the top drive may be used to apply the rotation to the drillstring. The rotation may be applied repeatedly to overcome torsional tension stored in the drillstring. In general, in sliding drilling, the top drive is used to rotate the drillstring a determined amount at surface where the determined amount of rotation is calculated to reorient the bent sub downhole by a desired amount. However, if too much rotation is provided by the top drive at the surface, the bent sub past will rotate downhole past the desired orientation. Similarly, if not enough rotation is applied by the top drive, the bent sub will not rotate as much as required for aligning the drill bit with the desired trajectory.

In a sliding drilling system, the bottomhole assembly may comprise a magnetic sensor for determining a magnetic orientation of the bent sub/drill bit (orientation relative to magnetic or true north) and/or a gravity sensor for determining a gravitational orientation of the bent sub/drill bit (orientation relative to the Earth's gravitational field). The sliding drilling system may also include a torque sensor configured to determine a value or range of values of torque applied to the drill bit by the motor(s) (top drive and/or downhole motor) and/or a weight-on-bit ("WOB") sensor configured to detect a value or range of values for WOB at or near the bottomhole assembly.

In one embodiment of the present disclosure, a method is provided for automated control of a drillstring in a borehole, which is not in continuous rotation, containing an angled component (a bent sub) and a downhole means of rotating the bit, such as a motor or turbine which rotates the bit independently of drillstring rotation. Near the distal end of the drillstring are measurement devices, at least one and in some aspects two or more, which may be used to measure the orientation of the drillstring/bent sub/bottomhole assembly/drill bit with respect to a geophysical field of the earth, such as magnetism (magnetic toolface) or gravity (gravitational toolface). These measurement devices may be connected to a communications module which transmits the downhole toolface information to the surface using one or more of a number of communications channels (for instance acoustic telemetry through the fluid, acoustic telemetry through the structure of the drillstring, electromagnetic radiation through the earth or through a wire or other conductive path in the drillstring).

For a particular formation and bottomhole assembly ("BHA"), the combination of orientation and WOB largely determines the instantaneous direction of drilling. In some aspects of the present invention, drilling direction of the direction drilling system may be determined from a depth average orientation of the toolface (not a time averaged orientation) and the WOB. In aspects of the present disclosure, many other measurements may be made by downhole instruments related both to the drilling process (e.g. rotation speed, weight, torque, bending, internal and annular pressure) and formation properties (e.g. gamma ray, density, porosity, resistivity, acoustic wave speeds, nuclear-magnetic spectra) and which are also either transmitted to surface, recorded downhole or both.

In order to change the orientation of the downhole toolface, the drillstring at the surface may be moved in rotation. When the drillstring is near-vertical, any rotation at the surface will result in a downhole rotation, but as the hole angle becomes more horizontal, the transmission of rotation downhole becomes more erratic due to friction. Additionally, axial movements of the drillstring become less and less easy to propagate downhole, and continuous movement of the top of the drillstring does not necessarily result in a smooth increase in weight applied to the drillstring. Methods that employ automated alternating clockwise and anti-clockwise rotation in order to ease both weight transfer and drillstring orientation transfer from the top of the drillstring to the bottom have previously been described. This method is known colloquially as pipe-rocking.

In sliding drilling, WOB influences the toolface. As WOB is increased, the toolface will have the tendency to orient opposite to the rotation of the bit. Whereas, as WOB is decreased, the toolface will have the tendancy to orient in the same direction as the rotation of the bit. Therefore, WOB can be used to adjust toolface, and when adjusting WOB drillstring during the drilling process, orientation of the drillstring needs to be adjusted in order to maintain toolface.

In sliding drilling, frictional forces affect the ability to control WOB, which in turn affects toolface orientation and/or control of toolface orientation. As a result, the ability to seek and hold toolface must accommodate three interrelated considerations, WOB, toolface, and friction forces. Given these difficulties, manual toolface control tends to be a trial and error operation, and drillers will typically not adjust WOB once they have achieved a desired toolface.

Although the downhole toolface direction is determined at least in part by the orientation of the drillstring at the surface, the ability to measure the drillstring orientation at the surface may be absent, or if it is present it may not be coupled into the control system for the mechanism that rotates the drillstring at surface (normally either a top-drive or a rotary-table). Additionally, the measurement of the downhole toolface direction may be imprecise, inaccurate and sparse. For example, due to the constraints of the telemetry channel from the BHA to the surface, the downhole data may be transmitted to surface with limited precision, and—since the downhole toolface varies (due to torque variations for instance), and the average toolface that determines direction is the depth-average, not the time-average—even a time-averaged downhole toolface many not correlate completely with the direction in which drilling is actually proceeding.

Thus, in some embodiments of the present disclosure, an automated method of slide drilling is provided that does not require a means of rotation that is directly coupled to the measurement of surface orientation, is robust to the inherent inaccuracies in the measurement of downhole toolface, and/or which does not require constant WOB. Additionally, in aspects of the present disclosure, to aid in analyzing the progress of the borehole trajectory and the relationship of the trajectory to the drilling parameters, such as tool face and WOB, depth average and/or survey point displays are provided.

In sliding drilling, toolface direction consists of instantaneous values and logs of the recorded instantaneous values over time. In order for the drilling personnel to have a better understanding of where the borehole is going (the trajectory of the borehole), in aspects of the present invention, a depth weighted display of toolface direction may be provided. This feedback of toolface may be provided on a stand basis, on a section basis, or to monitor results after a change in target (e.g. well placement decision).

Figure 3:
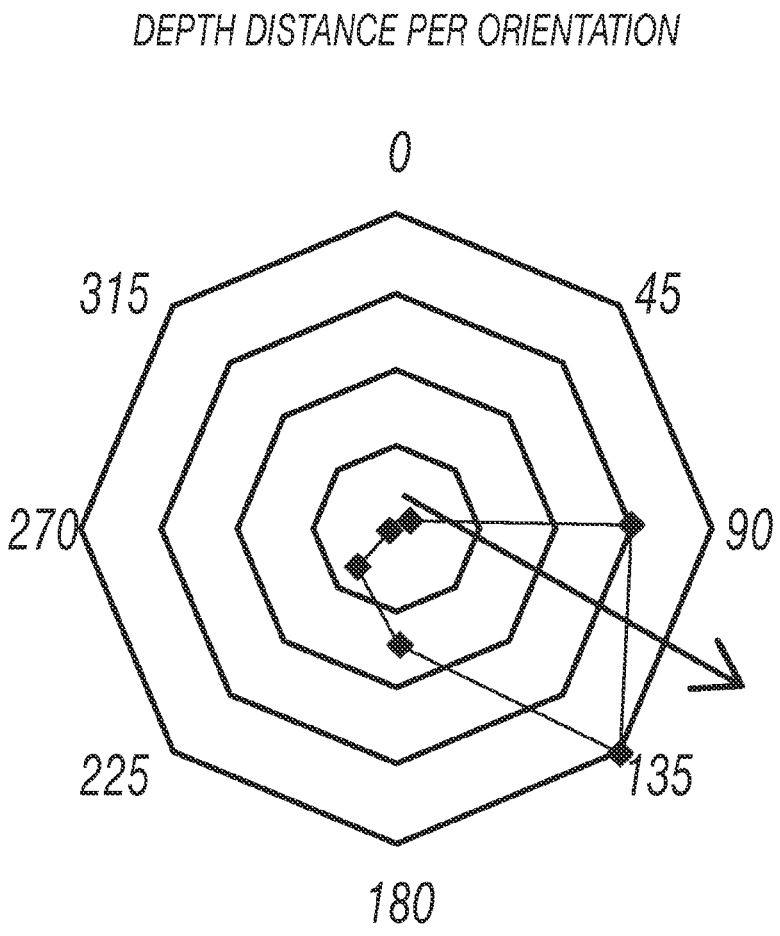
FIG. 3 illustrates a visual depiction of the information/data of FIG. 2 in which drilling depth for each toolface value is displayed and overall orientation tendency of the drilling system is provided to give a depth weighted average.

One example of how this data may be presented is provided in FIG. 3. In FIG. 3, the drilling depth for each toolface value is displayed and overall orientation tendency is provided to give the depth weighted average.

In another aspect, virtual survey points determined from the operational conditions (gravity toolface, WOB) are processed and displayed, where the virtual points are located between actual survey points where the downhole toolface is measured. A cone of uncertainty may be calculated based on the distance from the last actual survey point as well as signal quality of the intermediate measure points. This uncertainty will continue to grow until the next actual survey point is taken, but can still allow drilling personnel to make better informed decisions.

A first embodiment of the present invention is applied when the drillstring surface orientation is kept largely constant, and a second embodiment is applied when the drillstring surface orientation is varying due to the use of pipe-rocking. Within each embodiment, there are two different cases, one where there is a means of measuring the surface orientation of the drillstring and one where there is not.

In addition to the downhole apparatus described above, there are means at surface, normally electronic, of acquiring the sensor data, and also a means (which may be located at the rig or remotely) of making the calculations which are described below, and transmitting these to the rotational drive of the drillstring (i.e. the top-drive or rotary table).

Surface Orientation Largely Constant, No Means of Measuring Surface Orientation

In an embodiment of the present invention where the surface orientation is largely held constant and no means of measuring surface orientation is provided, the downhole orientation is controlled automatically through rotation of the drillstring at surface, from one fixed position to another, but based only on downhole measurements.

In such an embodiment, adjustment may be necessary because, based on the current downhole toolface, the trajectory of the borehole (determined by the use of downhole measurements of geophysical orientation), the projected future trajectory will not be sufficiently close to the planned trajectory of the well/borehole (where the plan may change dynamically based on other downhole or surface measurements).

In some embodiments, using methods such as simulation, empirical methods such as those based on evaluation of previous performance when drilling similar boreholes and/or the like, a range of downhole toolfaces is calculated within which the projected future trajectory of the borehole will be sufficiently close to a desired borehole trajectory. An impulse is applied to the drillstring at the surface, which again based either on calculation or empirical observation, is thought sufficient to move the downhole toolface to within the acceptable range. After the impulse, the drillstring may be locked and/or a toolface and orientation measurements are made downhole (drilling may or may-not proceed during these measurments), and the results transmitted to the surface. If the toolface is within an acceptable range, no further impulses are applied to the drillstring. But if it is outside of the range, then another impulse is applied, in order to bring the toolface within the range. This process is repeated until an acceptable toolface is reached.

Depending on the method of control used on the drilling rig, the impulse may either be a torque impulse (i.e. a turning the drillstring either with a controlled torque, or at a controlled rate until a particular torque has been achieved), or a rotation speed impulse (application of a particular rotation speed for a set period, or application of a particular rotation speed trajectory over a period). Note that due to differences in the actual and desired rotation speed, and timing errors, the angle turned when applying the rotation speed impulse will be different from the integral of the desired rotation speed over the impulse period.

Surface Orientation Largely Constant, with Orientation Measurement at the Surface The method of an embodiment where surface orientation of the drillstring is being measured is very similar to the previously described method, except in this case, the decision whether to repeat the application of an impulse is initially dependent on whether the surface drillstring orientation is within a range of angles which it has been estimated are likely to result in a downhole toolface that is within an acceptable range. Thus, in such an embodiment, one or more impulses are initially applied to the drillstring until the surface orientation is within the range of angles. In such embodiments, downhole data is monitored and if it is found the downhole toolface is outside of the range expected when the surface orientation is within the range of angles, the surface ranges are recalculated and further impulses are applied until the surface orientation is within the recalculated range of angles.

Surface Orientation Varying, without Orientation Measurement at the Surface

In this embodiment, rocking drilling is occurring such that a varying torque is being applied to the drillstring that oscillates between a maximum torque value and a minimum torque value. Normally, if drilling is proceeding in the correct direction, or sufficiently close, then the sum of the maximum and minimum value is zero, or close to zero (or more generally, the average value of the torque applied per cycle is close to zero). In rocking drilling, the magnitude of the maximum and minimum torques are such that the torque oscillations from the surface do not reach the bent-sub, and hence affect the downhole toolface.

In such an embodiment, where rocking drilling is underway, the downhole toolface is transmitted to surface, and if it is determined that the well trajectory is too far from the planned well trajectory, the maximum and minimum values are changed, with the sum of the maximum and minimum no longer being close to zero. In an embodiment of the present invention, if the toolface is to be turned clockwise, then the maximum torque is increased, so that the rotation now reaches the bent-sub which is then moved to the right. Similarly, if the toolface needs to be adjusted anti-clockwise, then the minimum torque is reduced.

In an embodiment of the present invention, the non-zero sum maximum and minimum values, and the time over which they are applied is calculated so as to move the downhole toolface into an acceptable range. If, based on the downhole measurements success has been achieved then zero-sum values are again used. Based on the results of the torque application, then either or both of the maximum and minimum values will be adjusted so as to move the downhole orientation to within the acceptable range.

Surface Orientation Varying, with Surface Orientation Measurement

In an embodiment of the present invention where rocking drilling is being performed and surface orientation is being measured, after the surface torque variation has returned to zero-sum values, the determination is made as to whether the surface orientation is, when averaged over one or more torque variation cycles, within an acceptable range, and based on this a decision is made whether to apply another non zero-sum set of values for a time. Again, if based on downhole measurements the surface ranges are found not to be correct, the surface ranges are updated and a further non-zero sum set of cycles applied.

In some embodiments of the present invention, toolface adjustments may be made by varying WOB and/or varying WOB and torque. In embodiments of the present invention, simulation, modelling and/or more empirical methods such as those based on evaluation of previous performance when drilling similar wells may be used to process a target WOB range that when applied to the drilling system will adjust the toolface orientation such that the projected future trajectory of the well will be sufficiently close to the target trajectory. In such embodiments, WOB adjustments are made to bring WOB within the target WOB range.

The toolface is measured after application of the WOB adjustments and if the measured toolface is within the acceptable range, no further WOB adjustments are made. However, the toolface is outside of the acceptable range, than another adjustment is applied, in order to bring the toolface within the acceptable range. This process is repeated until an acceptable toolface is reached. This process may be combined with the other methods described herein, thus for instance, if the downhole or surface toolface/surface drillstring orientation is close to, but not within, the desired range, then a WOB adjustment may be made to bring it within the desired range. In other aspects, torque may be applied to the drillstring to change the surface orientation when the WOB is changed to mitigate downhole toolface changes produced by the change in WOB. In other aspects, torque changes and WOB changes may both be made in order to control the downhole toolface.

In some aspects of the present invention, downhole toolface may be modelled based upon a WOB or WOB and one or more other drilling parameters. This model may be used in determining a torque impulse to be applied to the drillstring at the surface. In some embodiments, the torque impulse may be modelled to determine a range of values of downhole toolface changes that will be produced by the torque impulse. For example, statistical analysis of probable outcomes produced by a torque impulse given parameters of the drilling procedure may be determined. In this way, a torque impulse most likely to produce a desired downhole toolface orientation may be calculated. By processing the torque impulse that will produce a desired range of toolface angles, uncertainties in measurement and communication of drilling parameters are accounted for in the method according to an embodiment of the present invention.

Figure 1B:
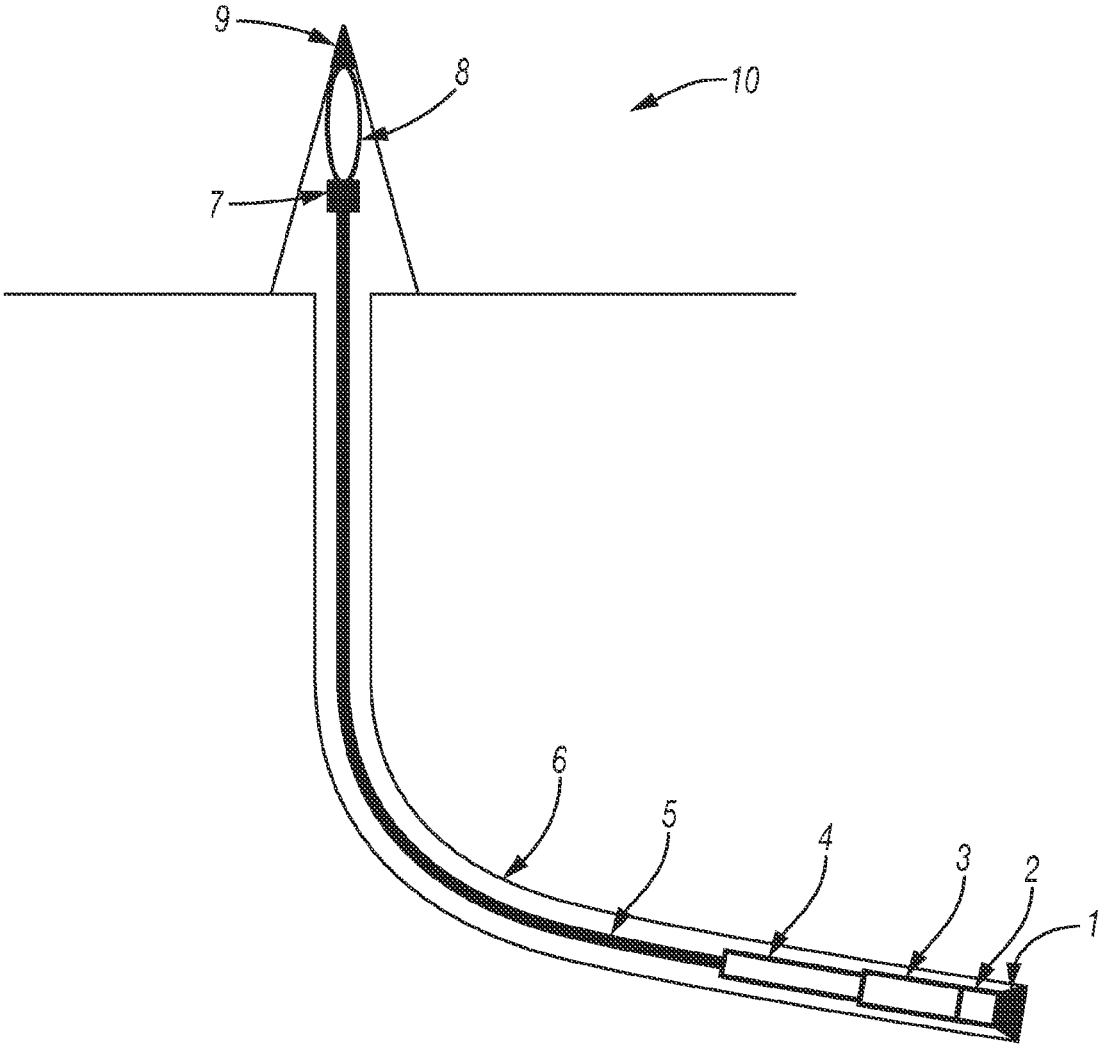
FIG. 1B illustrates a sliding drilling system comprising a downhole motor and bent sub.

FIG. 1B illustrates a sliding drilling system comprising a downhole motor and bent sub. The sliding drilling system comprises a bottomhole assembly (BHA) that terminates in a bit (1), which is attached to a bent-sub (2), and driven by a downhole motor or turbine (3). Connected to the downhole motor or turbine (3) is the remainder of the BHA (4), which contains the directional toolface measuring instruments (not shown), the telemetry system (not shown) and any other downhole measurement devices. This BHA is contained in a borehole (6) and connected to the top-drive (7) at the surface via drillpipe (5). In other embodiments the top-drive (7) may be another drive-mechanism, such as a rotary-table.

Figure 2:
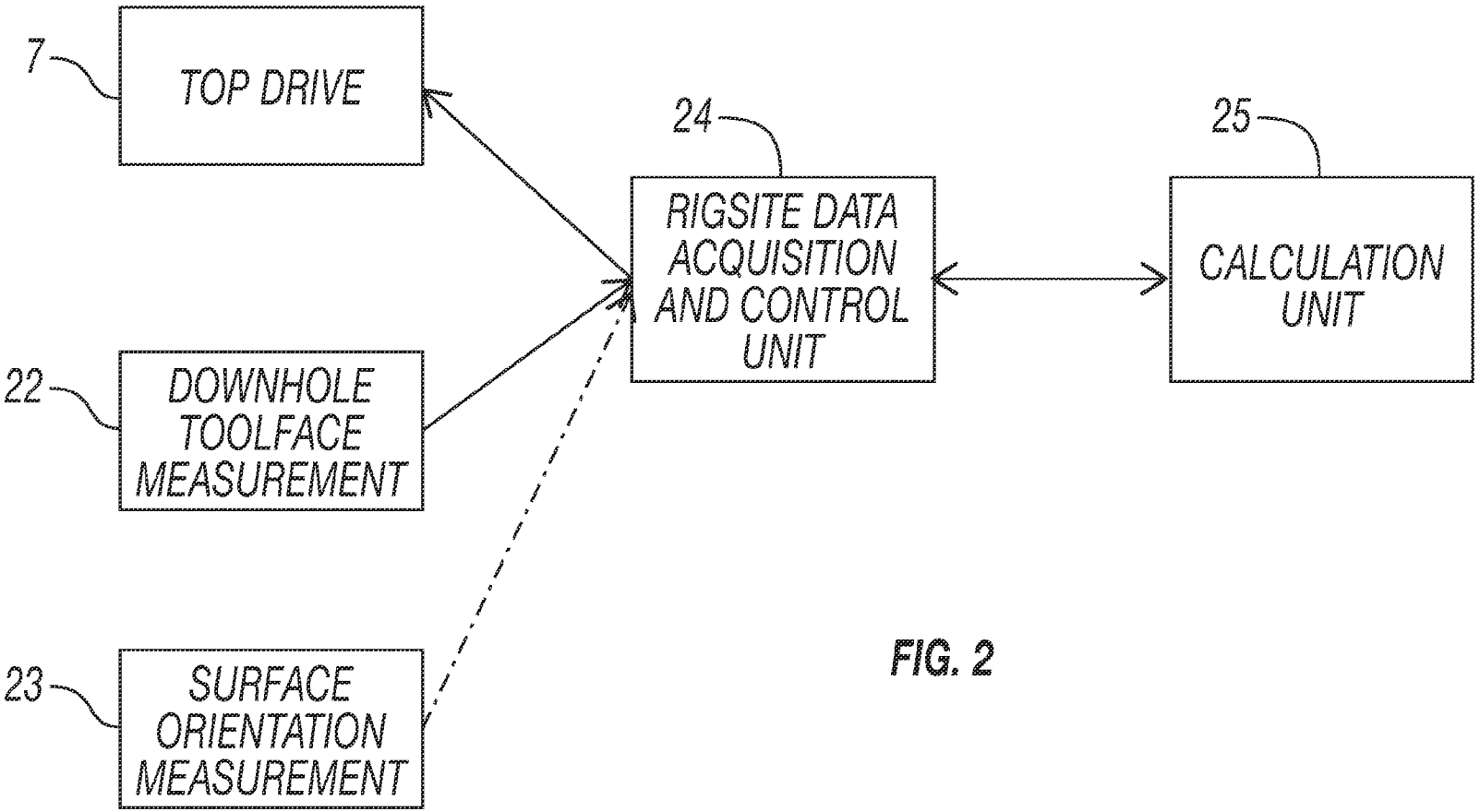
FIG. 2 schematically shows information/data flow in a sliding drilling system during a drilling procedure.

FIG. 2 schematically shows information/data flow in a sliding drilling system during a drilling procedure. The downhole toolface measurements (22) are transmitted to a rig-site data acquisition and control system (this may be two systems, one for acquisition, and one for control), as are the surface orientation measurements if present (which measure the orientation of the drillpipe at the top-drive or other rotational means (7), or some component of this which is attached to the drillpipe). The acquisition system transmits data to and from a calculation unit, which may be either present at the rig-site or at a remote location, and which informs the control unit (24) the downhole and (according to the particular implementation) surface angle limits required, and also the torque or rotation-speed impulse to transmit to the top-drive (7).

FIGS. 3 and 4 illustrate how data the data of FIG. 2 may be displayed and/or analysed for use in an automated sliding drilling system/procedure.

All references referred to above are hereby incorporated by reference for all purposes. While the principles of the disclosure have been described above in connection with specific apparatuses and methods, it is to be clearly understood that this description is made only by way of example and not as limitation on the scope of the invention.

What is claimed is:

1. An automated method for controlling a drilling system—the drilling system comprising a drillstring extending from a surface location down into a borehole being drilled by the drilling system, an angled component, a bottomhole assembly including a bit, and a downhole means for rotating the bit—to perform sliding drilling, the method comprising:

measuring a downhole toolface from an orientation of the drillstring with respect to a geophysical field of the earth;

communicating the downhole toolface measurement to the surface;

processing a borehole trajectory of the borehole from the downhole toolface measurement;

determining whether the borehole trajectory is within an acceptable range relative to a planned borehole trajectory; and when the borehole trajectory is outside of the acceptable range, determining an extent by which the borehole trajectory is outside of the acceptable range;

determining an impulse to use to bring the borehole trajectory within the acceptable range, the determined impulse including at least one of:

a torque impulse and a controlled rate of torque change until a target torque is achieved; or a rotation speed impulse and a particular rotation speed trajectory over time until a target rotation speed is achieved; and at the surface, applying the impulse in response to determining the borehole trajectory is outside of the acceptable range and determining the impulse.

2. The method of claim 1, wherein the downhole toolface measured from the orientation of the drillstring with respect to a geophysical field of the earth comprises one of a magnetic toolface or a gravitational toolface.

3. The method of claim 1, wherein the downhole means for rotating the bit comprises one of a turbine, a motor or a mud motor.

4. The method of claim 1, wherein determining whether the borehole trajectory is within the acceptable range relative to the planned borehole trajectory comprises performing a simulation to determine a range of downhole toolfaces within which range a projected future borehole trajectory produced by continued drilling will pass through desired target areas in an earth formation.

5. The method of claim 1, wherein determining whether the borehole trajectory is within the acceptable range relative to the planned borehole trajectory comprises evaluating or modeling previous performance when drilling the borehole or drilling one or more similar boreholes to determine a range of downhole toolfaces within which range a predicted borehole trajectory produced by continued drilling will pass through desired target zones in an earth formation.

6. The method of claim 1, wherein one or more parameters of the impulse are determined from prior experience drilling the borehole or drilling a similar borehole.

7. The method of claim 1, wherein one or more parameters of the impulse are calculated to be sufficient to move the downhole toolface to within the acceptable range.

8. The method of claim 1, further comprising:

locking the drillstring if the impulse produces an impulse-adjusted downhole toolface that is within the acceptable range.

9. The method of claim 1, wherein the impulse is a first impulse and further comprising:

applying a second impulse to the drillstring if an impulse-adjusted downhole toolface produced by the first impulse is outside of the acceptable range.

10. The method of claim 1, wherein communicating the downhole toolface measurement to the surface comprises communicating downhole measurements of toolface to the surface via wired drillpipe.

11. The method of claim 1, wherein determining whether the borehole trajectory is within the acceptable range relative to the planned borehole trajectory comprises determining whether a surface drillstring orientation produced by the impulse is within a range of angles producing a downhole toolface within the acceptable range.

12. An automated sliding drilling controller for controlling a drilling system—wherein the drilling system comprises a drillstring extending from a surface location down into a borehole being drilled by the drilling system, an angled component, a bottomhole assembly including a bit, and a downhole means for rotating the bit—to perform slide drilling, the automated sliding drilling controller comprising:

a toolface sensor configured to measure a downhole toolface from an orientation of the drillstring with respect to a geophysical field of the earth; and a telemetry system in communication with the toolface sensor and a terminal;

wherein the terminal is configured to:

process a borehole trajectory of the borehole from the downhole toolface measurement, determine whether the borehole trajectory is within an acceptable range relative to a planned borehole trajectory, measure reaction of the drillstring to adjusting parameters to be applied to the drill string, display a depth weighted average of the downhole toolface direction; and adjust parameters applied to the drillstring at the surface to adjust the downhole toolface if the borehole trajectory is determined to be not within the acceptable range, wherein the adjusted parameters applied to the drillstring at the surface provide for a first sequence of alternately rotating the drillstring in one direction until a first torque magnitude is reached and in an opposite direction until a second torque magnitude is reached where the first and second torque magnitudes differ until the downhole toolface is measured such that the trajectory of the borehole is within the acceptable range, or based on simulation or experience is anticipated to be within the acceptable range if the trajectory is outside of the acceptable range, and further provide for a second sequence of alternating direction and magnitude of rotations to the drillstring if the downhole toolface produced by the first sequence of alternating direction and magnitude of rotations is measured such that the borehole trajectory is outside of the acceptable range.

13. The controller of claim 12, wherein the adjusted parameters applied to the drillstring at the surface provide for rotating the drillstring to adjust the downhole toolface to within a range of desired downhole toolface directions.

14. The controller of claim 12, wherein the adjusted parameters applied to the drillstring at the surface provide for adjusting weight-on-bit.

15. The controller of claim 12, the display of the depth weighted average including a chart depicting a drilling depth for multiple toolface values.

16. The controller of claim 15, the chart further depicting an overall orientation tendency of the drilling system.

17. The controller of claim 12, the depth weighted average being provided on a stand basis or a section basis.

* * * * *